US008388102B2

(12) United States Patent
Urbistondo et al.

(10) Patent No.: US 8,388,102 B2
(45) Date of Patent: Mar. 5, 2013

(54) IMAGE FORMING APPARATUS, MAINTENANCE ASSEMBLY USABLE WITH IMAGE FORMING APPARATUS, AND METHOD THEREOF

(75) Inventors: Ainhoa Urbistondo, Barcelona (ES); Marta Coma, Barcelona (ES); Francesc Melia, Palma de Mallorca Illes Balears (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 50 days.

(21) Appl. No.: 13/076,047

(22) Filed: Mar. 30, 2011

(65) Prior Publication Data

US 2012/0249674 A1 Oct. 4, 2012

(51) Int. Cl.
*B41J 23/00* (2006.01)

(52) U.S. Cl. ..... 347/34; 347/36; 347/33; 347/35

(58) Field of Classification Search ..... 347/32, 347/35, 36, 33, 34
See application file for complete search history.

(56) References Cited

U.S. PATENT DOCUMENTS

| | | | | |
|---|---|---|---|---|
| 6,695,431 | B2 * | 2/2004 | Kumagai | 347/35 |
| 2002/0041303 | A1 * | 4/2002 | Yoshinaga | 347/22 |
| 2003/0067505 | A1 * | 4/2003 | Kumagai | 347/35 |
| 2006/0028519 | A1 * | 2/2006 | Nakamura et al. | 347/87 |
| 2006/0192833 | A1 * | 8/2006 | Samoto et al. | 347/108 |
| 2007/0109348 | A1 * | 5/2007 | Izawa et al. | 347/34 |
| 2008/0143781 | A1 * | 6/2008 | Inoue et al. | 347/34 |
| 2008/0316254 | A1 * | 12/2008 | Byun | 347/36 |
| 2009/0066749 | A1 * | 3/2009 | Young et al. | 347/36 |
| 2009/0128598 | A1 * | 5/2009 | Desire et al. | 347/36 |
| 2010/0207993 | A1 * | 8/2010 | Yearout et al. | 347/33 |

* cited by examiner

*Primary Examiner* — Matthew Luu
*Assistant Examiner* — Lily Kemathe

(57) ABSTRACT

A method of maintaining a fluid applicator unit of an image forming apparatus in which the fluid applicator unit includes a nozzle surface having nozzles is disclosed. The method includes ejecting fluid through nozzles of a fluid applicator unit of an image forming apparatus during a maintenance mode to maintain flow paths therethrough such that the fluid is emitted from the nozzles in a form of fluid drops. The method also includes receiving the fluid drops emitted from the nozzles during the maintenance mode on a receiving member to form waste liquid therefrom and directing the waste liquid from the receiving member to a waste receiving unit through a liquid passage. The method also includes directing aerosol formed from the fluid drops emitted from the nozzles to the aerosol receiving unit through an aerosol passage such that the aerosol passage is separate from the liquid passage and receiving the aerosol directed to the aerosol receiving unit.

13 Claims, 5 Drawing Sheets

IMAGE FORMING APPARATUS, MAINTENANCE ASSEMBLY USABLE WITH IMAGE FORMING APPARATUS, AND METHOD THEREOF

BACKGROUND

Image forming apparatuses include fluid applicator units having nozzles such as inkjet print heads to emit ink to media in the form of ink drops to form images thereon. The image forming apparatuses may periodically perform maintenance procedures with respect to the nozzles to maintain flow paths therethrough.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming apparatus includes a fluid applicator unit including a nozzle surface having nozzles such as an inkjet print head to emit fluid to media in a form of fluid drops to form images thereon in an application mode. The image forming apparatus may also periodically perform maintenance procedures with respect to the nozzles to maintain flow paths therethrough in a maintenance mode. That is, in a maintenance mode, the fluid applicator unit may periodically perform spitting procedures in which fluid is ejected through the nozzles to maintain flow paths therein. Thus, subsequent ejection of fluid may pass through the nozzles in an unobstructed manner. The fluid drops emitted from the nozzles, however, may form aerosol which, if not properly removed, may contaminate components such as sensors causing malfunctioning thereof and reduce the lifespan of the image forming apparatus.

Further, the removal of aerosol and waste liquid formed, for example, during the maintenance mode of the image forming apparatus through at least a shared portion of a common passage may overtime result in obstruction of the passage. For example, fluid such as latex ink may require heat such as in the form of hot air in the printzone to sufficiently cure itself on media. As an aerosol passage may include airflow to extract aerosol therethrough, hot air may be introduced into the shared portion of the common passage. The introduction of the hot air into the common passage may cause the waste liquid to harden therein and subsequently obstruct the shared portion of the common passage. Consequently, proper collection of the waste liquid and extraction of the aerosol would be hindered resulting in potential malfunctioning of components of the image forming apparatus and a reduction in the lifespan thereof due to aerosol contamination.

In examples, a method of maintaining a fluid applicator unit of an image forming apparatus in which the fluid applicator unit includes a nozzle surface having nozzles is disclosed. The method includes, among other things, directing waste liquid from a receiving member to a waste receiving unit through a liquid passage and directing aerosol formed from fluid drops emitted from the nozzles to an aerosol receiving unit through an aerosol passage. Moreover, the aerosol passage is separate from the liquid passage. That is, no portion of the aerosol passage and liquid passage are shared with each other. Accordingly, the extraction of aerosol and collection of waste liquid can be effectively performed, thus potentially reducing the malfunctioning of components and reduction in the lifespan of the image forming apparatus due to aerosol contamination.

Figure 1:
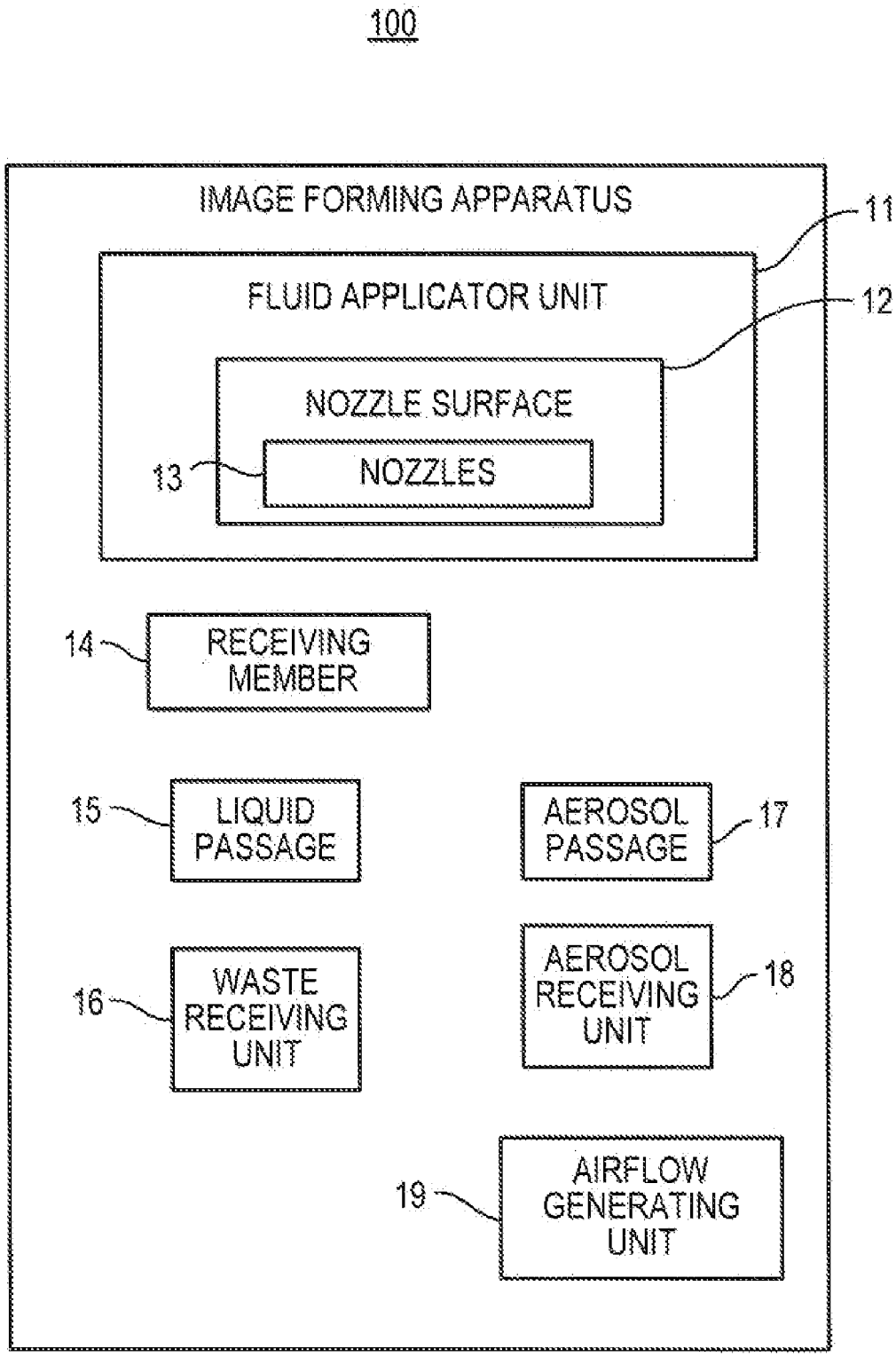
FIG. 1 is a block diagram of an image forming apparatus according to an example.

FIG. 1 is a block diagram of an image forming apparatus according to an example. The image forming apparatus 100 is usable with media 21 (FIG. 2) and includes a maintenance mode and an application mode. Referring to FIG. 1, the image forming apparatus 100 includes a fluid applicator unit 11, a receiving member 14, a liquid passage 15, a waste receiving unit 16, an aerosol passage 17, an aerosol receiving unit 18, and an airflow generating unit 19. In examples, the image forming apparatus 100 may be a digital copier, printer such as an inkjet printer, bookmaking machine, facsimile machine, multi-function machine, or the like. In an example, the fluid applicator unit 11 may include an inkjet print head, or the like, and the fluid may include ink and/or other types of fluids. The term ink is used generally herein, and encompasses any type of pigment or colorant such as toner, or other type of image forming material, and may be in a variety of forms such as liquid, semi-liquid, semi-solid, or other forms that is used to be ejected by a fluid applicator unit 11.

Figure 2:
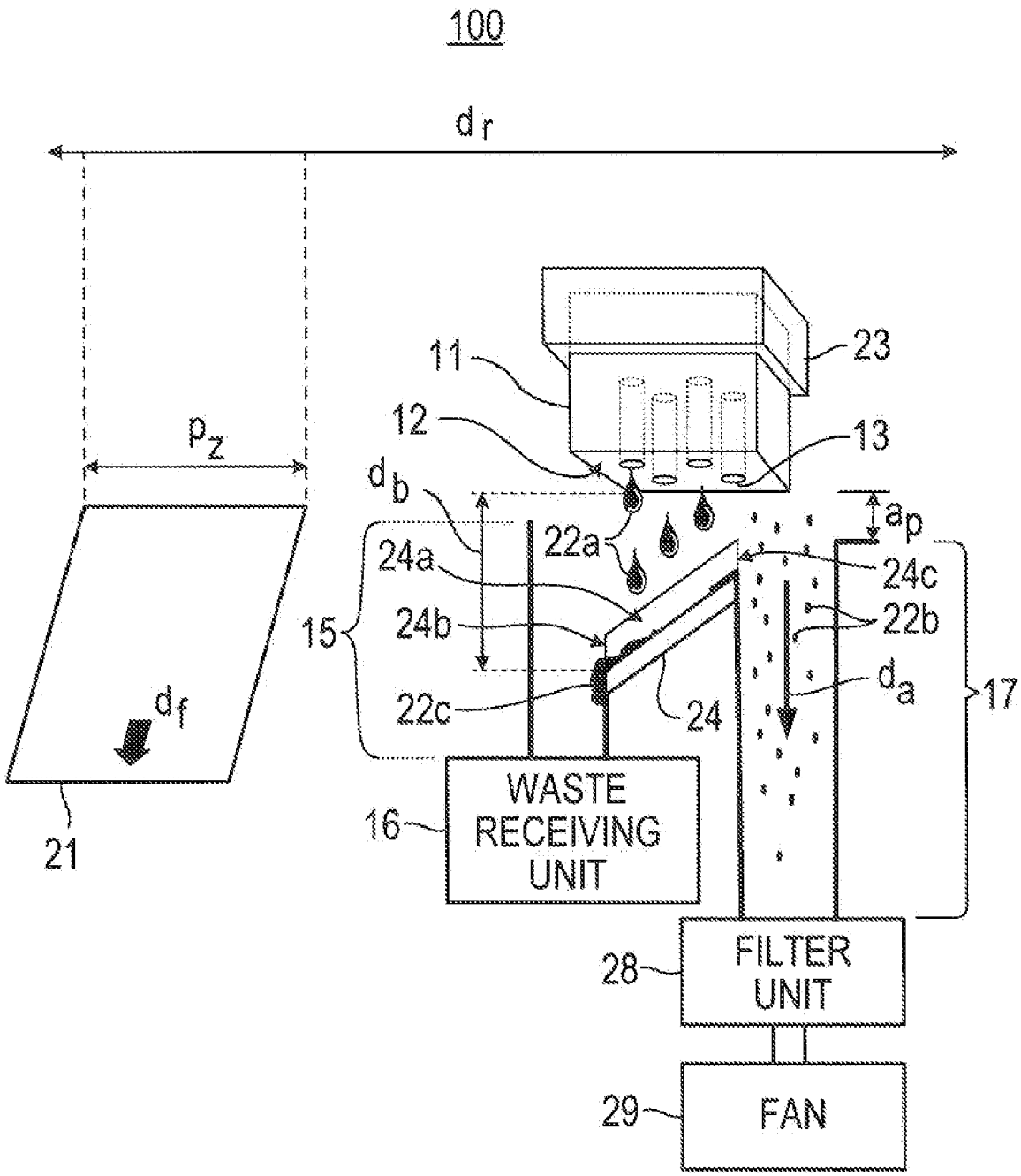
FIG. 2 is a schematic view of the image forming apparatus of FIG. 1 according to an example.

FIG. 2 is a schematic view of the image forming apparatus of FIG. 1 according to an example. Referring to FIGS. 1 and 2, in examples, the fluid applicator unit 11 includes a nozzle surface 12 having nozzles 13. The fluid applicator unit 11 is configured to eject fluid through the nozzles 13 to form images on media 21 in an application mode, maintain flow paths in the nozzles 13 in a maintenance mode, and emit the fluid from the nozzles 13 in a form of fluid drops 22*a*. In an example, the aerosol passage 17 may be disposed between an upper end of the receiving member 14 and the aerosol receiving unit 18. For example, the upper end of the receiving member 14 may be an ascended end 24*c* of an impact surface 24*a* of a spit plate 24. The aerosol receiving unit 18 is configured to receive aerosol 22*b* formed from the fluid drops 22*a* emitted from the nozzles 13. In an example, the aerosol receiving unit 18 may include a filter unit 28 configured to filter the aerosol 22*b* received by the filter unit 28. In the present example, the aerosol passage 17 is configured to transport the aerosol 22*b* from an area $a_p$ proximate to the nozzle surface 12 to the aerosol receiving unit 18. For example, the area $a_p$ proximate to the nozzle surface 12 may include an area between the nozzle surface 12 and an entrance to the aerosol passage 17 when the fluid applicator unit 11 is at a predetermined maintenance position. The airflow generating unit 19 such as a fan 29 is configured to generate airflow in the aerosol passage 17 directed toward the aerosol receiving unit 18. That is, the airflow direction $d_a$ is along the aerosol passage 17 and towards the aerosol receiving unit 18.

Referring to FIGS. 1 and 2, in the present example, the receiving member 14 is configured to receive the fluid drops 22*a* emitted from the nozzles 13 in the maintenance mode to form waste liquid 22*c* from the fluid drops 22*a*. In an example, the receiving member 14 may include a spit plate 24 having an impact surface 24*a*. The impact surface 24*a* is configured to contact the fluid drops 22*a* emitted from the nozzles 13 to the impact surface 24*a* to form the waste liquid 22*c*. The impact surface 24*a* may be disposed in a non-parallel manner with respect to the nozzle surface 12 to form a descending slope with respect to the liquid passage 15 to direct the waste liquid 22*c* to the liquid passage 15. The impact surface 24*a* may include a descended end 24*b* and an ascended end 24*c* disposed higher than the descended end 24*b* with respect to the nozzle surface 12 of the fluid applicator unit 11. The waste receiving unit 16 is configured to receive the waste liquid 22*c* formed by contact between the fluid drops 22*a* and the receiving member 14. In an example, the liquid passage 15 may be disposed between a lower end of the receiving member 14 and the waste receiving unit 16. For example, the lower end of the receiving member 14 may be a descended end 24*b* of the impact surface 24*a* of the spit plate 24. The liquid passage 15 is configured to transport the waste liquid 22*c* from the receiving member 14 to the waste receiving unit 16 such that the liquid passage 22*c* is isolated from the airflow generated by the airflow generating unit 19. That is, the airflow generated by the airflow generating unit 19 does not pass through a portion of the liquid passage 15. In an example, the airflow generating unit 19 may include a fan 29 disposed downstream of the filter unit 28 with respect to the airflow direction $d_a$ generated by the fan 29.

Referring to FIG. 2, in examples, the image forming apparatus 100 may include a carriage unit 23 configured to removably receive the fluid applicator unit 11. The carriage unit 23 reciprocates the fluid applicator unit 11 across a print zone $p_z$ during the application mode. For example, the carriage unit 23 may move back and forth in a reciprocating direction $d_r$ transverse to a media feed direction $d_f$. The carriage unit 23 positions the fluid applicator unit 11 at a predetermined maintenance position disposed across from the impact surface 24*a* of the spit plate 24 during the maintenance mode. In examples, in the maintenance mode, the fluid drops 22*a* may be emitted from the nozzles 13 while the fluid applicator unit 11 is static (e.g., static spit) or moving (e.g., dynamic spit). In examples, a distance $d_b$ between the nozzle surface 12 of the fluid applicator unit 11 in the predetermined maintenance position and the impact surface 24*a* of the spit plate 24 is no more than ten millimeters (mm). In the present example, the distance $d_b$ may be approximately 3 mm. For example, the distance $d_b$ may correspond to a sufficient length to minimize the formation of aerosol 22*b* and to allow the receiving member 14 to have a sufficient slope (e.g., inclination) to direct the waste liquid 22*c* to the liquid passage 15.

Figure 3:
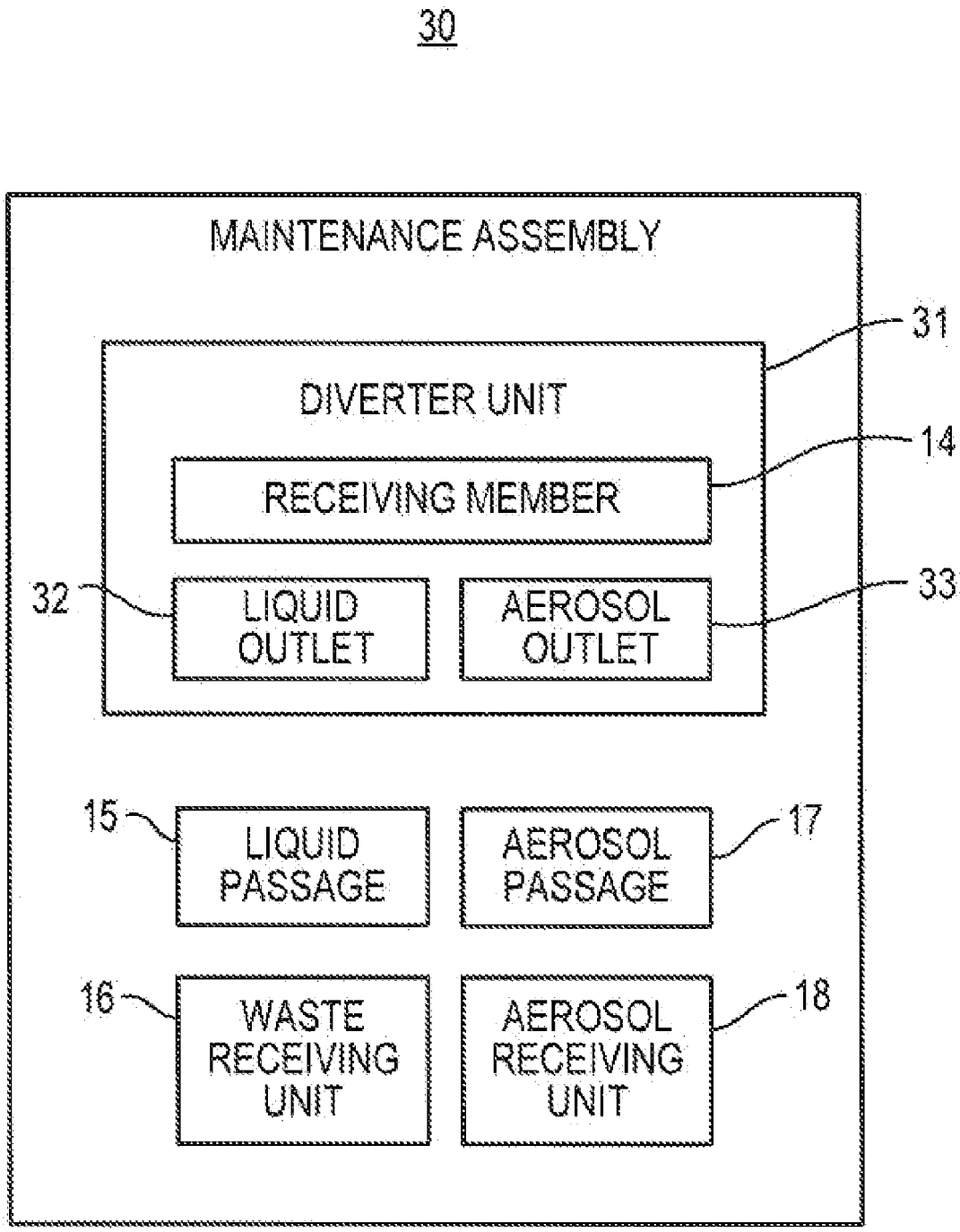
FIG. 3 is a block diagram of a maintenance assembly usable with an image forming apparatus according to an example.
Figure 4:
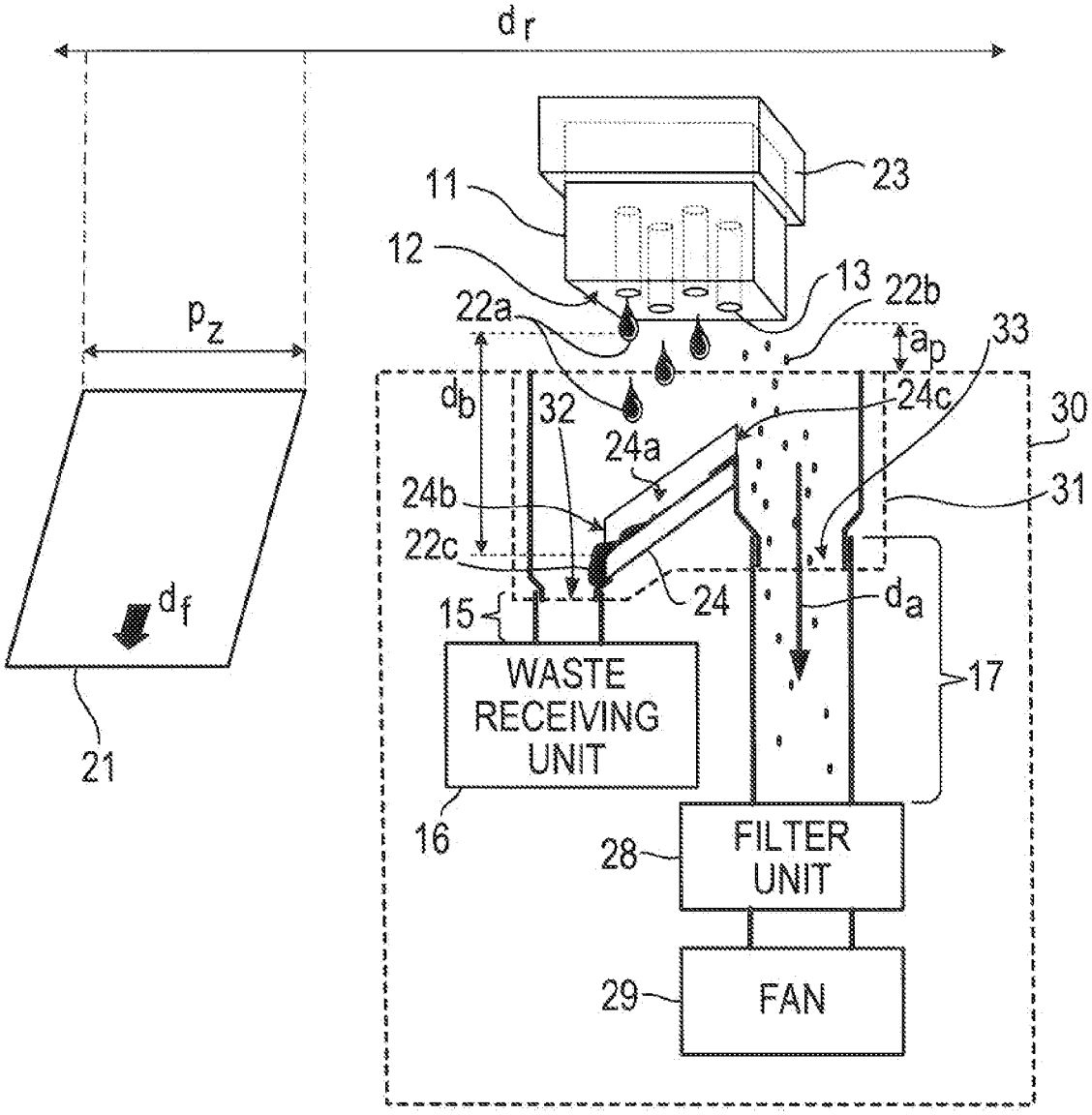
FIG. 4 is a schematic view of the maintenance assembly of FIG. 3 according to an example.

FIG. 3 is a block diagram of a maintenance assembly according to an example. The maintenance assembly 30 is usable with an image forming apparatus including a fluid applicator unit 11 including a nozzle surface 12 having nozzles 13 (FIG. 4). The maintenance assembly 30 includes a diverter unit 31 including a receiving member 14, a liquid outlet 32 and an aerosol outlet 33. The maintenance assembly 30 also includes an aerosol receiving unit 18, an aerosol passage 17, a waste receiving unit 16, and a liquid passage 15. The liquid passage 15 and the aerosol passage 17 are separate from each other. That is, no portion of the aerosol passage 17 and liquid passage 15 are shared with each other.

FIG. 4 is a schematic view of the maintenance assembly of FIG. 3 according to an example. Referring to FIGS. 3 and 4, in the present example, the receiving member 14 is configured to receive the fluid drops 22*a* emitted from the nozzles 13 in the maintenance mode to form waste liquid 22*c* from the fluid drops 22*a*. In an example, the receiving member 14 may include a spit plate 24 having an impact surface 24*a*. The impact surface 24*a* is configured to contact the fluid drops 22*a* emitted from the nozzles 13 to the impact surface 24*a* to form the waste liquid 22*c*. The impact surface 24*a* may be disposed in a non-parallel manner with respect to the nozzle surface 12 to form a descending slope with respect to the liquid passage 15 to direct the waste liquid 22*c* to the liquid passage 15.

Referring to FIG. 4, in examples, the waste receiving unit 16 is configured to receive the waste liquid 22*c* formed by contact between the fluid drops 22*a* and the receiving member 14. In an example, the liquid passage 15 is disposed between the liquid outlet 32 and the waste receiving unit 16. The liquid passage 15 is configured to transport the waste liquid 22*c* from the receiving member 14 to the waste receiving unit 16. In an example, the aerosol passage 17 is disposed between the aerosol outlet 33 and the aerosol receiving unit 18 such as a filter unit 28. The aerosol passage 17 is configured to transport the aerosol 22*b* from the aerosol outlet 33 to the aerosol receiving unit 18. In an example, the maintenance assembly 30 may also include an airflow generating unit 19 configured to generate airflow in the aerosol passage 17 directed toward the aerosol receiving unit 18. For example, the maintenance assembly 30 may include a fan 29 disposed downstream of the filter unit 28 with respect to the airflow direction $d_a$ generated by the fan 29. Image forming apparatus usable with the maintenance assembly 30 may include a carriage unit 23 as previously disclosed with respect to the image forming apparatus 100 illustrated in FIG. 2. Also, in examples, the distance $d_b$ between the nozzle surface 12 of the fluid applicator unit 11 in the predetermined maintenance position and the impact surface 24*a* of the spit plate 24 is no more than ten millimeters (mm). In the present example, the distance $d_b$ may be approximately 3 mm.

Figure 5:
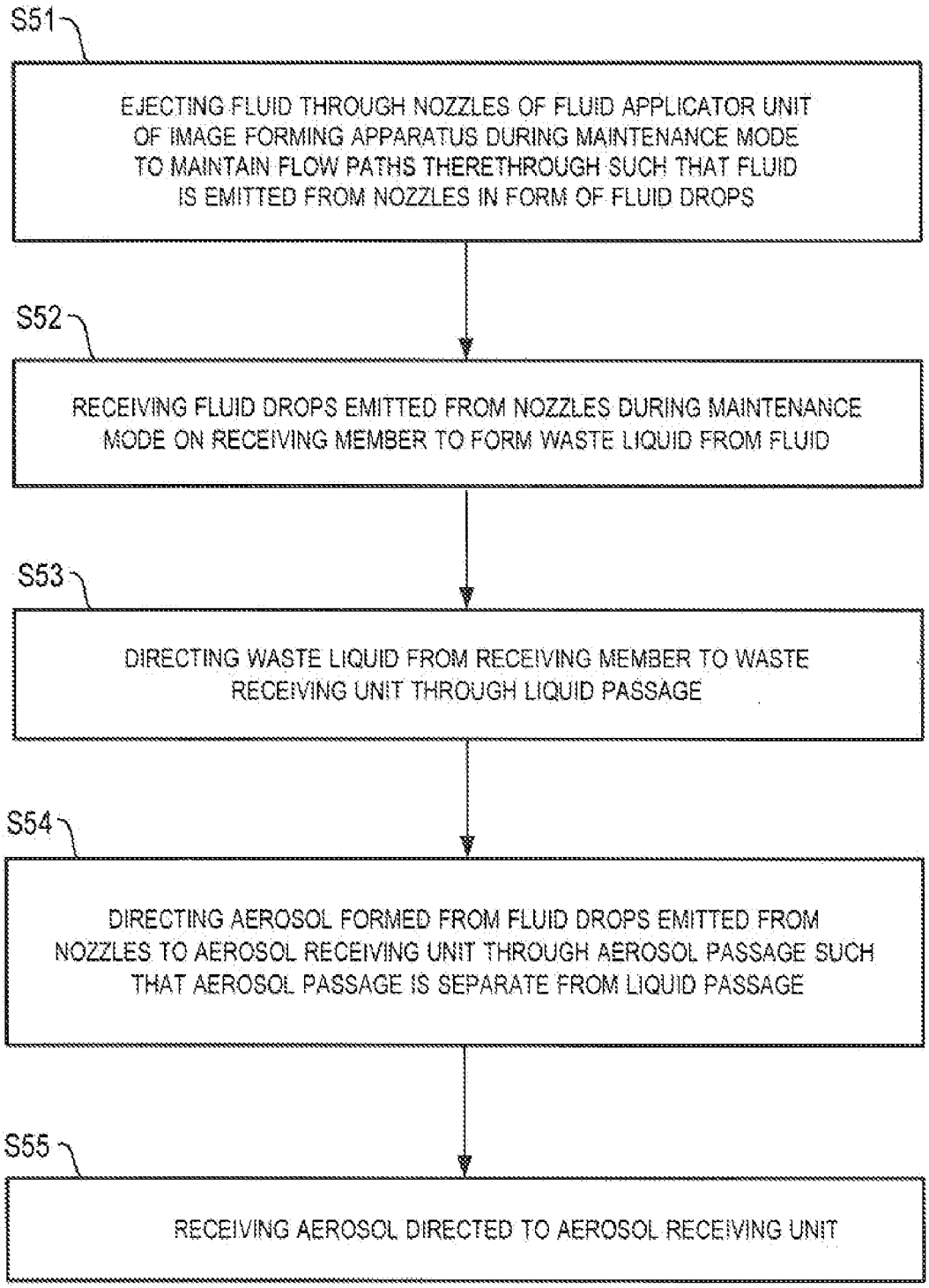
FIG. 5 is a flowchart illustrating a method of maintaining a fluid applicator unit of an image forming apparatus in which the fluid applicator unit includes a nozzle surface having nozzles according to an example.

FIG. 5 is a flowchart illustrating a method of maintaining a fluid applicator unit of an image forming apparatus in which the fluid applicator unit includes a nozzle surface having nozzles according to an example. Referring to FIG. 5, in block S51, fluid is ejected through nozzles of a fluid applicator unit of an image forming apparatus during a maintenance mode to maintain flow paths therethrough such that the fluid is emitted from the nozzles in a form of fluid drops. In an example, ejecting fluid through nozzles of a fluid applicator unit may include positioning the fluid applicator unit at a predetermined maintenance position disposed across from the fluid applicator unit during the maintenance mode. In block S52, the fluid drops emitted from the nozzles during the maintenance mode are received on a receiving member to form waste liquid from the fluid. In an example, the receiving member may include a spit plate having an impact surface configured to contact the fluid drops emitted from the nozzles thereto. The impact surface may be disposed in a non-parallel manner with respect to the nozzle surface to form a descending slope with respect to the liquid passage.

Referring to FIG. 5, in block S53, the waste liquid is directed from the receiving member to a waste receiving unit through a liquid passage. In an example, directing the waste liquid from the receiving member may include forming the waste liquid from the fluid drops emitted from the nozzles to the spit plate through the contact between the fluid drops and the impact surface of the spit plate. In an example, directing the waste liquid from the receiving member may also include transporting the waste liquid along the descending slope of the impact surface into the liquid passage. In block S54, aerosol formed from the fluid drops emitted from the nozzles is directed to the aerosol receiving unit through an aerosol passage such that the aerosol passage is separate from the liquid passage. That is, no portion of the aerosol passage and liquid passage are shared with each other. In an example, the directing aerosol formed from the fluid drops emitted from the nozzles may further include generating airflow in the aerosol passage disposed between the fluid applicator unit and the aerosol receiving unit such that the airflow is directed toward the aerosol receiving unit. Also, the airflow generated by the aerosol receiving unit may transport the aerosol from an area proximate to the nozzle surface to the aerosol receiving unit. In the present example, the liquid passage is isolated from the airflow generated by the airflow generating unit. In block S55, the aerosol directed to the aerosol receiving unit is received therein. In an example, the aerosol receiving unit may include a filter unit configured to filter the aerosol received by the filter unit. Also, the airflow generating unit may include a fan disposed downstream of the filter unit with respect to the airflow direction generated by the fan.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A maintenance assembly usable with an image forming apparatus including a fluid applicator unit including a nozzle surface having nozzles, the maintenance assembly comprising:

a diverter unit including a receiving member, a liquid outlet and an aerosol outlet such that the receiving member is configured to receive fluid drops emitted from nozzles of a fluid applicator unit and form waste liquid therefrom;

the receiving member including a spit plate having an impact surface, the impact surface including a descended end and an ascended end disposed higher than the descended end with respect to the nozzle surface;

an aerosol receiving unit configured to receive aerosol formed from the fluid drops emitted from the nozzles;

an aerosol passage extending from the ascended end of the impact surface and configured to transport the aerosol from the aerosol outlet to the aerosol receiving unit, the aerosol passage disposed between the ascended end of the impact surface and the aerosol receiving unit;

a waste receiving unit configured to receive the waste liquid from the receiving member; and a liquid passage extending from the descended end of the impact surface and configured to transport the waste liquid from the liquid outlet to the waste receiving unit, the liquid passage disposed between the descended end of the impact surface and the waste receiving unit; and wherein the liquid passage and the aerosol passage are separate from each other.

2. The maintenance assembly according to claim 1, wherein:

the aerosol passage is disposed between the aerosol outlet and the aerosol receiving unit; and the liquid passage is disposed between the liquid outlet and the waste receiving unit.

3. The maintenance assembly according to claim 2, further comprising:

an airflow generating unit configured to generate airflow in the aerosol passage directed toward the aerosol receiving unit.

4. The maintenance assembly according to claim 3, wherein the receiving member comprises:

the spit plate having the impact surface configured to contact the fluid drops emitted from the nozzles and form the waste liquid therefrom such that the impact surface is disposed in a non-parallel manner with respect to the nozzle surface to form a descending slope with respect to the liquid passage to direct the waste liquid thereto.

5. The maintenance assembly according to claim 4, further comprising:

a carriage unit configured to removably receive the fluid applicator unit, the carriage unit reciprocates the fluid applicator unit across a print zone during an application mode and positions the fluid applicator unit at a predetermined maintenance position across from the impact surface of the spit plate during a maintenance mode.

6. The maintenance assembly according to claim 5, wherein a distance between the nozzle surface of the fluid applicator unit in the predetermined maintenance position and the impact surface of the spit plate is no more than ten millimeters.

7. The maintenance assembly according to claim 3, wherein the aerosol receiving unit comprises a filter unit configured to filter the aerosol received by the filter unit and the airflow generating unit comprises a fan disposed downstream of the filter unit with respect to the airflow direction generated by the fan.

8. An image forming apparatus usable with media, the image forming apparatus having a maintenance mode and an application mode, comprising:

a fluid applicator unit including a nozzle surface having nozzles, the fluid applicator unit configured to eject fluid through the nozzles to form images on media in an application mode, maintain flow paths in the nozzles in a maintenance mode, and emit the fluid from the nozzles in a form of fluid drops;

an aerosol receiving unit configured to receive aerosol formed from the fluid drops emitted from the nozzles;

a receiving member configured to receive the fluid drops emitted from the nozzles in the maintenance mode to form waste liquid therefrom, the receiving member including a spit plate having an impact surface, the impact surface including a descended end and an ascended end disposed higher than the descended end with respect to the nozzle surface;

an aerosol passage extending from the ascended end of the impact surface and configured to transport the aerosol from an area proximate to the nozzle surface to the aerosol receiving unit, the aerosol passage disposed between the ascended end of the impact surface and the aerosol receiving unit;

an airflow generating unit configured to generate airflow in the aerosol passage directed toward the aerosol receiving unit;

a waste receiving unit configured to receive the waste liquid formed by contact between the fluid drops and the receiving member; and a liquid passage extending from the descended end of the impact surface and configured to transport the waste liquid from the receiving member to the waste receiving unit such that the liquid passage is isolated from the airflow generated by the airflow generating unit, the liquid passage disposed between the descended end of the impact surface and the waste receiving unit.

9. The image forming apparatus according to claim 8, wherein the spit plate having the impact surface configured to contact the fluid drops emitted from the nozzles thereto to form the waste liquid such that the impact surface is disposed in a non-parallel manner with respect to the nozzle surface to form a descending slope with respect to the liquid passage to direct the waste liquid thereto.

10. The image forming apparatus according to claim 9, further comprising:

a carriage unit configured to removably receive the fluid applicator unit, the carriage reciprocates the fluid applicator unit across a print zone during the application mode and positions the fluid applicator unit at a predetermined maintenance position disposed across from the impact surface of the spit plate during the maintenance mode.

11. The image forming apparatus according to claim 10, wherein a distance between the nozzle surface of the fluid applicator unit in the predetermined maintenance position and the impact surface of the spit plate is no more than ten millimeters.

12. The image forming apparatus according to claim 8, wherein the aerosol receiving unit comprises a filter unit configured to filter the aerosol received by the filter unit and the airflow generating unit comprises a fan disposed downstream of the filter unit with respect to the airflow direction generated by the fan.

13. The image forming apparatus according to claim 8, wherein the fluid comprises ink, the fluid applicator unit comprises an inkjet print head, and the image forming apparatus comprises an inkjet printer.

* * * * *